US005326289A

United States Patent [19]

Leisey

[11] Patent Number: 5,326,289

[45] Date of Patent: Jul. 5, 1994

[54] FEMALE HYPERBOLOID ELECTRICAL CONNECTOR AND THE METHOD FOR FABRICATING SAME

[76] Inventor: Donald R. Leisey, 8142 Jefferson St., Hummelstown, Pa. 17036

[21] Appl. No.: 89,196

[22] Filed: Jul. 12, 1993

[51] Int. Cl.[5] ..... H01R 13/11

[52] U.S. Cl. ..... 439/851; 29/882

[58] Field of Search ..... 439/851-854; 29/882

[56] References Cited

U.S. PATENT DOCUMENTS 1,833,145 11/1931 Wilhelm .
2,450,529 10/1948 Sprigg .
2,711,524 6/1955 Beaver ..... 439/851
3,107,966 10/1963 Bonhomme .
3,314,044 4/1967 Powell ..... 439/851
4,203,647 5/1980 Bonhomme .
4,447,108 5/1984 Ghigliotti et al. .
4,720,157 1/1988 Nestor et al. ..... 439/851
4,804,587 6/1989 Lancella .

*Primary Examiner*—Steven C. Bishop
*Attorney, Agent, or Firm*—Gerald Post

[57] ABSTRACT

A female electrical connector formed of sheet metal to receive a cylindrical male pin. The connector is configured as hyperboloid of revolution with the generatrices comprising a plurality of flat and straight beam members disposed between a pair of cylindrical ferrules. The beam members bear against the inserted pin along a contact length so the bearing therebetween is a surface of each beam member partially wrapping around the pin to effect electrical continuity therebetween.

The beam members are automatically formed when the ferrules are rolled into cylinders without any part of the tooling touching the beams.

4 Claims, 1 Drawing Sheet

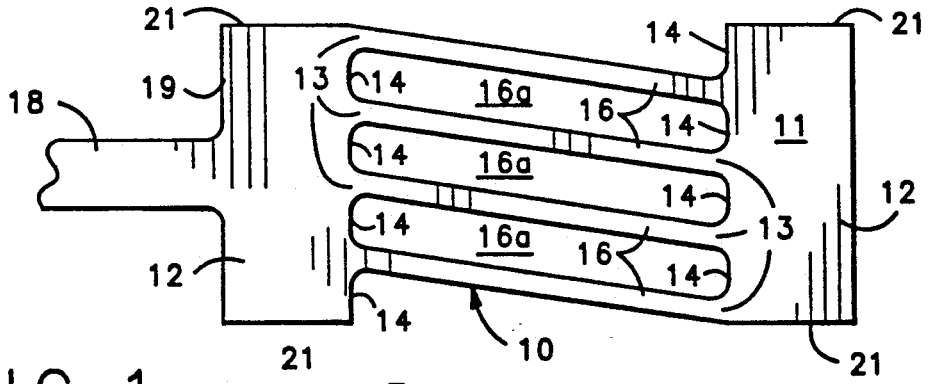
FIG 1
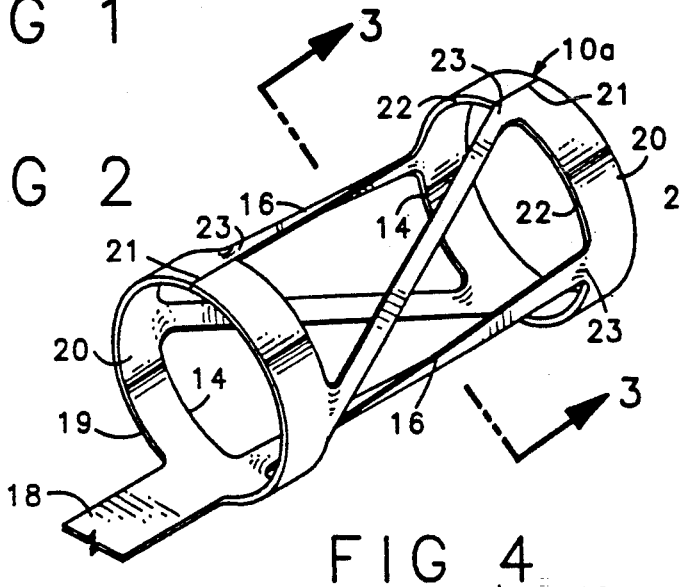
FIG 2
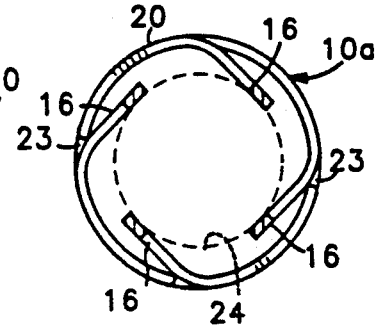
FIG 3
FIG 4
FIG 5
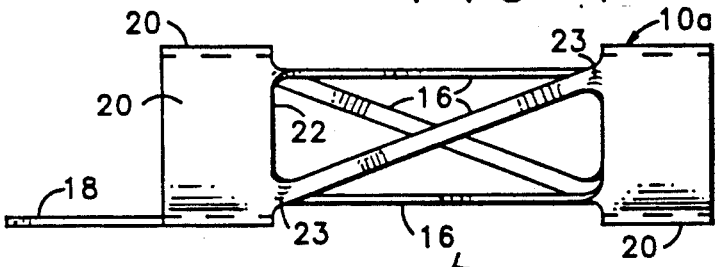
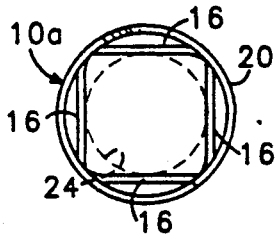
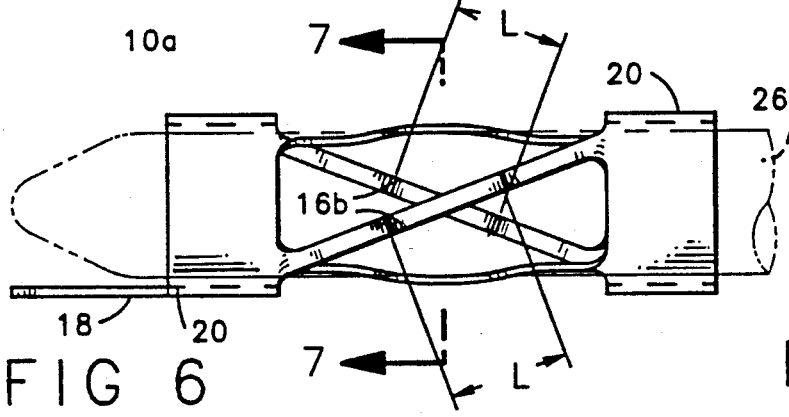
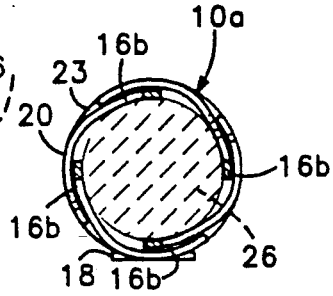
FIG 6
FIG 7

FEMALE HYPERBOLOID ELECTRICAL CONNECTOR AND THE METHOD FOR FABRICATING SAME

BACKGROUND OF THE INVENTION

1. Field of the Invention

The present invention is directed to the field of electrical connectors and in particular the design of a female connector configured as a hyperboloid of revolution and the method of fabricating the connector.

2. Description of the Prior Art

Female electrical connectors or sockets configured by a plurality of flexible beam elements to take on the geometric shape of a hyperboloid of revolution are well known in the connector industry. In the hyperboloid, a three dimensional geometric shape having the appearance of an hour glass, the surface is generated by a plurality of straight line beam elements or generatrices. The diameter at the narrowest point of a cross section called the throat is smaller than the diameter of the inserted male member or pin causing spacial interference therebetween. As a result, the beams must deflect outward creating a contact force between the pin and the socket.

Several types of such sockets are shown in prior art patents. In one construction, the surface of a cylindrical tube is milled or sawn to form slots in the central section of the tube leaving a plurality of beam elements defined by the material remaining after the machine cuts. These beams may be straight as elements of a cylinder or partially wrap helix-like around the surface of the tube at an angle skewed with the longitudinal axis. The tube is then formed into the final shape of the desired socket by applying torsional forces at the ends of the tube to twist the beams into a hyperboloid-like shape. This torsional action is transmitted through every beam element of the connector which, in turn, twists each beam and allows the machined edges to come into contact with an inserted male pin member thus making for a generally inferior electrical connection. Such devices are disclosed in U.S. Pat. No. 2,450,529 to Sprigg and U.S. Pat. No. 4,480,587 to Lancella and U.S. Pat. No. 4,447,108 to Ghiglotti et. al.

In another type of hyperboloid connector, a plurality of wire beams is secured to a pair of end rings or ferrules. In U.S. Pat. No. 3,107,966 to Bonhomme, the wire elements are stretched within the diameter of a rigid tube attached to the ferrules to form the hyperboloid configuration of the connector. The rigid tube is required in order to keep the assembly from collapsing under the tension forces induced in the wires. This construction utilizes a large number of components with the concomitant high assembly costs. In another U.S. Pat. No. to Bonhomme (4,203,647), a similar construction is employed including the multiplicity of wires this time initially positioned as elements of a cylinder, and an equivalent rigid member for assuring the integrity of the connector configuration. This assembly is then loaded in torsion by twisting forces applied to the ferrules repositioning the wires into the hyperboloid configuration. Both of the Bonhomme patents form a connector having line contact between the round male pin and the round wire beam resulting in a less efficient, high resistance electrical contact since a round wire beam is only conformable to a round pin along a line of contact.

Another method is revealed in U.S. Pat. No. 1,833,145 to Wilhelm. Wilhelm punches a plurality of parallel and equally spaced slots into a flat blank of sheet metal that will be configured into the beams of the connector. The blank is then formed into a tube having the slots disposed longitudinally and parallel to the axis of the tube. The final step in Wilhelm's method is to twist the tube in order to position the beams as elements of a hyperboloid. As previously explained, this operation also exposes sheared edges to create high resistance at the interface with the inserted pin member.

These prior art devices either comprise a multiplicity of components or a necessary final step of twisting the tube to form a socket having the required hyperboloid configuration. Not only does this twisting action require an additional step in the fabrication process, it also places the beams in torsion thereby distorting them along the longitudinal axis, so efficient contact with the inserted pin is precluded.

SUMMARY OF THE INVENTION

The present invention overcomes the limitations of the prior art. It is the principle object of this invention to form a female electrical connector or socket having contacting beam members arranged as elements of a hyperboloid fabricated without necessitating a twisting operation that would distort these elements from their initial flat and straight ribbon-like configuration.

A further object of the invention is to fabricate the socket from a single piece of electrically conductive sheet metal.

A still further object is to construct the socket without the need of a secondary joining process to maintain the shape of the socket.

A still further object is to provide a socket having uniform and equal contact pressure of smooth beam members that partially wrap around the inserted pin to preclude the possibility of the sheared edges of the beams coming into contact with the inserted pin member.

These and other objects are achieved by the preferred embodiment of the present disclosure which comprises a one piece stamping of thin resilient and conductive sheet metal that will subsequently be configured into a socket. The fabrication of sheet metal stock at a mill is accomplished by a rolling operation that provides smooth, flat and scratch free surfaces. It is only the sheared edges that would be relatively rough and could contain burrs from the shearing process. This inherent feature of sheet metal can be put to advantage in the present invention as will be discussed.

The stamping includes a pair of spaced apart rectangular panels separated by a predetermined distance and oriented to dispose the closest or joining edges of each to be parallel. The panels are connected by a plurality of elongated and spaced apart beam members spanning the distance from and integral with the joining edge of one panel to a point on the corresponding joining edge of the other panel. The angle the longitudinal axis of the beam members makes with the joining edges must be other than 90 degrees.

To complete the formation of the socket, the panels are shaped into hollow circular cylinders or ferrules with the corresponding joining edges forming the circumference of the ferrules. The inner diameter of the ferrules will be larger than the diameter of the male pin. During this step in the fabrication, the beams do not come into contact with any part of the tooling, but simultaneously assume their natural position as generatrices of a hyperboloid as the ferrules are shaped. As has been noted, many of the prior art sockets require an additional external twisting action to form the hyperboloid, but in forming the ferrules in the Applicant's invention, the beam members are automatically aligned into the elements of a hyperboloid of revolution from the single piece of sheet metal. Since there is no tool force against the beam members, no twisting forces can be transmitted along the length of the beam members and so they maintain a relatively planar ribbon shape within their intermediate portions. The hyperboloid formed will necessarily have a throat diameter less than the diameter of the ferrules and, as predetermined by the geometry of the blank, the throat diameter will also be smaller than the diameter of the inserted pin.

Insertion of the pin to complete an electric circuit spreads the beams outwardly putting compressive contact pressure against the pin. It is important to note that in creating the pressure against the pin, the beam members are deflected outward and put into a bending mode. The beams maintain their initial configuration and partially wrap around the pin with the mill finished surface against the pin creating an area of contact. This cannot be achieved with wire beam members because a wire will only have line contact against a round pin. Since the broad contact surface of the beam members of the present invention comprises the mill finish of the sheet stock, a smooth and conforming surface bears against the pin throughout the insertion and withdrawal action. This is the optimum contact integrity for a male-female connector and is a significant feature of this invention that none of the prior art sockets achieves. When the hyperboloid beam members are formed by a twisting action, the sheared edges of the beams will contact the pin to preclude a smooth sliding action and is a deficiency of certain of the prior art devices.

Having in mind the above and other objects that will be obvious from an understanding of the disclosure, the present invention comprises a combination and arrangement of parts illustrated in the presently preferred embodiment of the invention which is herein set forth in sufficient detail to enable those persons skilled in the art to clearly understand the function, construction and advantage of it when viewed in conjunction with the accompanying drawings.

BRIEF DESCRIPTIONS OF THE DRAWINGS

The invention will be described in detail, by way of example, with reference to the accompanying drawings.

FIG. 1 is the flat blank used to fabricate the socket;

FIG. 2 is a pictorial view of the formed connector;

FIG. 3 is a sectional view taken along line 3—3 in FIG. 2;

FIG. 4 is a side orthographic side view of the socket;

FIG. 5 is an orthographic end view of the socket;

FIG. 6 is a side view of the socket with the pin inserted; and

FIG. 7 is a sectional view taken along line 7—7 in FIG. 6.

DETAILED DESCRIPTION OF THE PREFERRED EMBODIMENT

Referring to FIG. 1 of the drawings and in accordance with the principles of the invention, a flat blank 10 stamped from a thin sheet of electrically conductive sheet metal is shown. The surface 11 of this material is smooth and flat due to the rolling process in its fabrication. The blank comprises a pair of spaced apart rectangular panels 12 each having corresponding joining edges 14 disposed parallel to and facing one another. A plurality of parallel apertures **16*a* punched into the blank 10 delineates the panels 12 and the beam members 16. The finished blank 10 now comprises a plurality of elongated and equally spaced apart beam members 16 having end portions 13 each connected to one of the edges 14 of the panels 12 and integral therewith. The beam members 16 are disposed in a non-perpendicular relationship with the edges 14. A tab 18 extends from one of the panels 14 from an edge 19 opposite to the joining edge 16. This tab 18** will serve as a connection point for a hook-up wire by a process of soldering, crimping, or other well known joining methods.

Referring now to FIGS. 2 through 5, the blank 10 is shown worked into a female connector or socket configuration **10*a* by forming the panels 12 into spaced apart cylindrical rings or ferrules 20 having the joining edges 14 now comprising the circumferential edges 22 of the ferrules 20. It is important to note that the tooling used to form the cylindrical ferrules 20 from the flat panels 12 does not contact the beam members 16 during this process. These beam members 16 remain flat, straight and untwisted and assume a spacial position between the ferrules 20 determined by their geometry and initial orientation with the blank 12. Because the beam members 16 are not urged to move in any particular position by tool contact, they must position themselves as a family of gereratrices of a hyperboloid of revolution. In forming the cylindrical ferrules 20, the edges 21 adjacent to the facing edge 14** are brought into proximity to one another to leave a zero or small gap therebetween and retain this position due to the permanent deformation of the material. No additional joining procedure need be employed.

Although the transition from the cylindrical shape of the ferrule 20 to the flat configuration of the beam members 16 takes place in a zone of transconfiguration 23 where the geometric shape of the surface changes, it is important to note that the beam members 16 remain substantially flat between these zones 23. Although any beam member 16 of finite width will attempt to conform to the envelope of a hyperboloid, the relatively slender beam members 16 considered in the present construction will in fact remain substantially flat. Resistance of the beam members 16 in deviating from the flat is due to their stiffness in a bending mode parallel to their longitudinal axes. For purposes of illustration, FIG. 2 exaggerates the curvature a beam member 16 might take, but in practicality the beams remain flat after the connector has been formed.

The throat diameter 24 of the hyperboloid is shown in FIG. 3 and is the smallest diameter that is created as measured as the diameter 24 of a circle tangent to each of the beam members 16 inscribed in a section taken perpendicular to its longitudinal axis. This diameter 24 must be smaller than the outer diameter of the male cylindrical pin 26 that is inserted through the socket **10*a* to make a separable electrical connection therebetween. The diameter of the pin 26 is necessarily smaller than the inner diameter of the ferrules 20** to permit insertion.

Referring to FIGS. 6 and 7, the pin 26 is shown inserted through both ferrules 20 of the socket **10*a* thereby expanding the beam members 16*b* outward. It is a feature of this invention that the stressed beam members 16*b* will each deflect equally and radially outward without twisting and partially wrap themselves around the pin. This is illustrated in a comparison of the sectional views of FIG. 3 and FIG. 7. Only the mill finish of the stock contacts the pin, a uniformly firm, aggressive and efficient electrical contact between the beams 16***a* and pin 26 is attained since contact resistance is a function of contact area and surface conditions. This comes about because no torsional forces were exerted against the beam members 16 during the manufacturing process as previously explained. The contact between the pin 26 and the beam members 16*b* takes place along a contacting length L where the beams 16*b* actually wrap around and bear against the pin 26. This length L lies along the beam members 16*b* between the transconfiguration zones 23.

The comparatively small size along with the low and smooth insertion force achieved when fabricating and utilizing this socket makes it feasible to assemble an array of sockets to form a multi-pin connector. The center distances between pins in a grid pattern can be less than one millimeter.

While the preferred embodiments of the invention are described, it will be understood that the invention is in no way limited by these embodiments.

What is claimed is:

1. In a female electrical connector formed of a flat blank of sheet metal and receptive of a male cylindrical pin for providing a separable conductive circuit therebetween, the improvement comprising:

a pair of spaced apart cylindrical ferrules concentrically disposed, each shaped by forming portions of said sheet metal into a tubular configuration, each ferrule having an inner diameter larger than the pin and each having spaced apart opposing circumferential edges separated by a predetermined distance; and a plurality of spaced apart substantially planar and elongated resilient beam members each spanning the distance between said edges and integral therewith, each beam member including a flat and straight portion intermediate of said ferrules defining a contact surface, said beam members simultaneously and automatically positioned as generatrices of a hyperboloid of revolution during the formation of said ferrules, said hyperboloid having a throat diameter less than that of the pin, wherein insertion of the pin through said ferrules causes said contact surfaces to bear against the inserted pin and deflect radially outward while partially wrapping around the pin for effecting low resistance electrical contact along said contact surface.

2. The connector as recited in claim 1 wherein portions of the flat blank of sheet metal includes a pair of rectangular panels each having spaced apart and parallel joining edges; and wherein said beam members are affixed to said joining edges in a non-perpendicular relationship, the connector obtained when forming said panels into the cylindrical configuration of the ferrules with the joining edges forming said circumferential edges thereof while said beam members simultaneously conform to a natural position as a family of straight generatrices of the hyperboloid while remaining planar within the contact surface of each.

3. The connector as recited in claim 1 wherein said ferrules are of equal diameter and said beam members are equally spaced apart.

4. A method of making a female electrical connector receptive of a male cylindrical pin for forming a separable conductive circuit therebetween comprising the steps of:

stamping thin electrically conductive flat sheet metal into a blank having a pair of spaced apart rectangular panels each including parallel and opposing joining edges separated by a predetermined distance and further including a plurality of parallel and spaced apart elongate flat beam members each having a central contact surface and each spanning said distance, said beam members affixed to said joining edges and extending non-perpendicularly therefrom; and forming said rectangular panels into cylindrical ferrules wherein said joining edges form the circumference of said ferrules, each ferrule having an inside diameter larger than said pin diameter, wherein the step of forming further causes said beam members to simultaneously conform to a position as a family of generatrices of a hyperboloid of revolution having a throat diameter less than that of the pin and each beam member having a flat central contact surface wherein insertion of the pin through said ferrules causes the contact surfaces of each beam member to bear against the pin for effecting electrical continuity between the pin and said beams.

* * * * *